US005277328A

United States Patent [19]

Tocco

[11] Patent Number: 5,277,328

[45] Date of Patent: Jan. 11, 1994

[54] MULTIPLY COMPARTMENTED COOLER

[76] Inventor: Gary A. Tocco, 31960 Little Mack, Roseville, Mich. 48066

[21] Appl. No.: 66,531

[22] Filed: May 24, 1993

[51] Int. Cl.[5] ..... B65D 83/04

[52] U.S. Cl. ..... 220/507; 222/142.9; 206/315.3; 220/254; 220/412; 220/4.12; 220/4.26; 220/772

[58] Field of Search ..... 220/254, 507, 516, 903, 220/142.9, 412, 4.12, 4.26, 772; 206/538, 315.3; 221/154

[56] References Cited

U.S. PATENT DOCUMENTS

| | | | |
|---|---|---|---|
| 3,358,818 | 12/1967 | Davis | 222/142.9 |
| 3,720,346 | 3/1973 | Cypher | 220/254 |
| 4,190,173 | 2/1980 | Mason et al. | 220/254 |
| 4,288,006 | 9/1981 | Clover, Jr. | 206/538 |
| 4,399,914 | 8/1983 | Damratowski et al. | 221/154 |
| 4,572,376 | 2/1986 | Wrennall | 206/538 |
| 4,778,054 | 10/1988 | Newell et al. | 206/538 |
| 4,991,737 | 2/1991 | Edelman | 220/254 |

*Primary Examiner*—Joseph Man-Fu Moy
*Attorney, Agent, or Firm*—Peter D. Keefe

[57] ABSTRACT

A cooler having multiple compartments, each of which affording individual access to only a specific portion of the cooler at any one time whereat only the contents of that specific compartment are subjected to being open to the air, while at the same time being compact, lightweight and portable. The cooler is composed generally of a body having a top end and a bottom end, and a lid rotatably mounted to the top end of the body. The body is provided with a plurality of compartments, wherein each compartment is in the form of blind cavities having an opening at the top end of the body. Each compartment is separated from each other compartment by a predetermined body thickness. The lid is provided with an access port having a cross-section substantially equal to the cross-section of the compartments. A dead-space having a cross-section at least as large as the cross-section of the access port is provided between a selected two adjacent compartments. The compartments, access port and dead-space are located equidistant from a line passing through the axial center of the body. Preferably, a handle is connected to the side of the body for providing a carrying structure.

20 Claims, 2 Drawing Sheets

FIG. 1
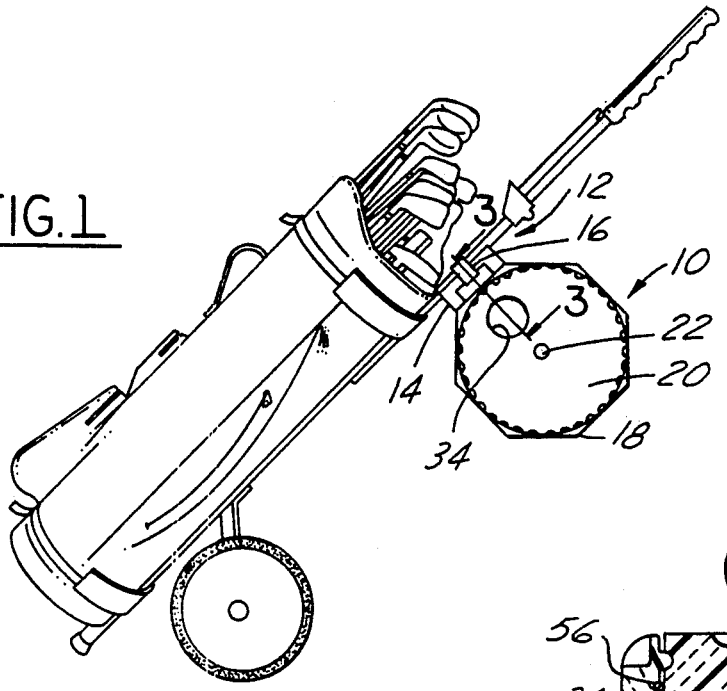
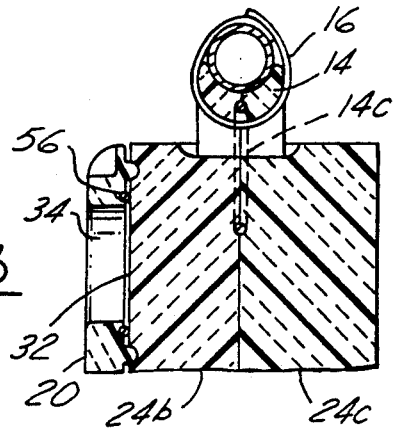
FIG. 3
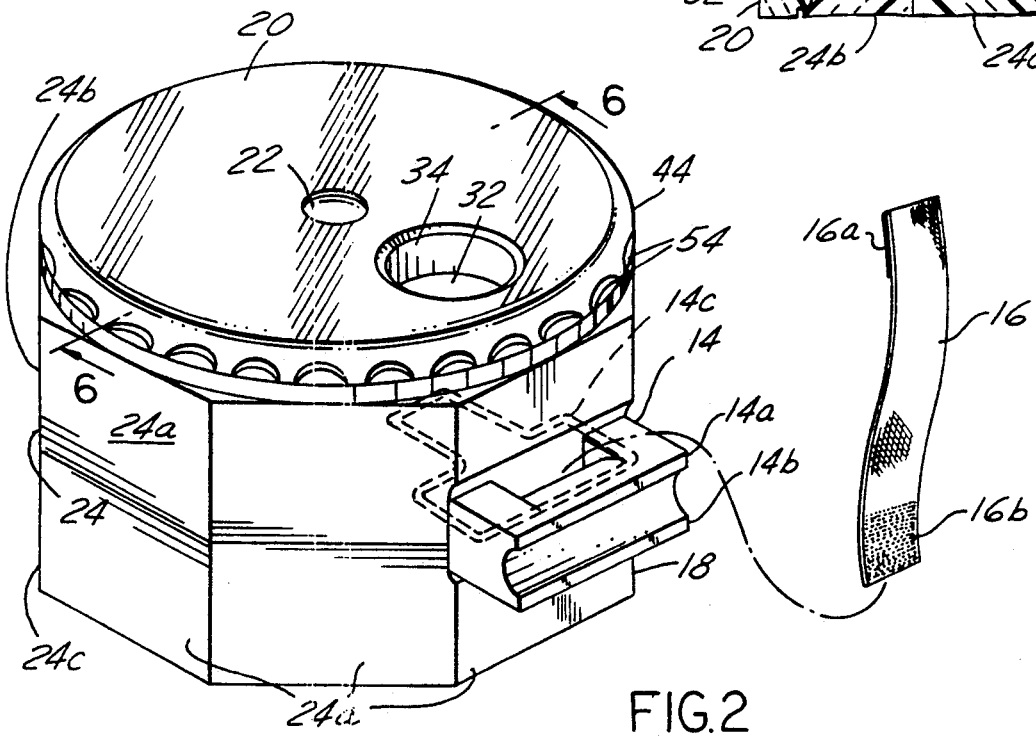
FIG. 2

MULTIPLY COMPARTMENTED COOLER

BACKGROUND OF THE INVENTION

1. Field of the invention

The present invention relates to coolers and more particularly to a cooler having a body equipped with multiple compartments, any one of which being individually accessible via selective alignment therewith by an access port located in a lid rotatably mounted to the body.

2. Description of the Relevant Art

Coolers are well known in the art to provide a portable structure having insulative properties for keeping foods and beverages cold or hot. Usually, coolers are constructed of four side walls of more-or-less rectangular shape joined by a bottom wall and a lid hingedly mounted to one of the side walls. While other shapes may also be used for coolers, there is the problem that opening the lid results in all the contents of the cooler being open to the air, thereby adversely affecting the insulatory performance of the cooler for any of the contents not being sought when the lid was opened.

Accordingly, what is needed in the art is a cooler which affords individual access to only a specific portion of the cooler at any one time whereat only the contents sought are subjected to being open to the air, while at the same time being compact, lightweight and portable.

SUMMARY OF THE INVENTION

The present invention is a cooler having multiple compartments, each of which affording individual access to only a specific portion of the cooler at any one time whereat only the contents of that specific compartment are subjected to being open to the air, while at the same time being compact, lightweight and portable.

The multiply compartmented cooler according to the present invention is composed generally of a body having a top end and a bottom end, and a lid rotatably mounted to the top end of the body. The body is provided with a plurality of compartments, wherein each compartment is in the form of blind cavities having an opening at the top end of the body. Each compartment is separated from each other compartment by a predetermined body thickness. The lid is provided with an access port having a cross-section substantially equal to the cross-section of the compartments. A dead-space having a cross-section at least as large as the cross-section of the access port is provided between a selected two adjacent compartments. The compartments, access port and dead-space are located equidistant from a line passing through the axial center of the body. Preferably, a handle is connected to the side of the body for providing a carrying structure.

In operation, the user stocks each of the compartments by rotating the lid so that the access port thereof comes into sequential alignment with each compartment. After the compartments are stocked, the access port is then aligned with the dead-space. To thereafter gain access to any selected compartment, the user simply rotates the access port into alignment with that compartment, extracts its contents, then rotates the access port back into alignment with the dead-space.

Accordingly, it is an object of the present invention to provide a cooler which permits exclusive access to individual compartments thereof.

It is an additional object of the present invention to provide a cooler having a body provided with plurality of compartments that are individually accessible by rotation of a lid alignably with respect to an access port provided therein.

It is a further object of the present invention to provide a cooler having a body provided with plurality of compartments that are individually accessible by rotation of a lid alignably with respect to an access port provided therein, wherein the body is provided with a plurality of side faces.

It is yet another object of the present invention to provide a cooler having a body provided with plurality of compartments that are individually accessible by rotation of a lid alignably with respect to an access port provided therein, wherein a handle is provided which affords easy connection to another object, such as a golf club bag cart.

It is still a further object of the present invention to provide a cooler having a body provided with plurality of compartments that are individually accessible by rotation of a lid alignably with respect to an access port provided therein, wherein the cooler is lightweight, durable, compact and portable.

These, and additional objects, advantages, features and benefits of the present invention will become apparent from the following specification.

BRIEF DESCRIPTION OF THE DRAWINGS

FIG. 1 is a perspective view of the multiply compartmented cooler according to the present invention, shown in a typical environment of use in connection with a golf club bag cart.

FIG. 2 is a perspective view of the multiply compartmented cooler according to the present invention.

FIG. 3 is a detail side view of the preferred handle structure for the multiply compartmented cooler according to the present invention, seen along line 3—3 in FIG. 1.

DETAILED DESCRIPTION OF THE PREFERRED EMBODIMENT

Figure 4:
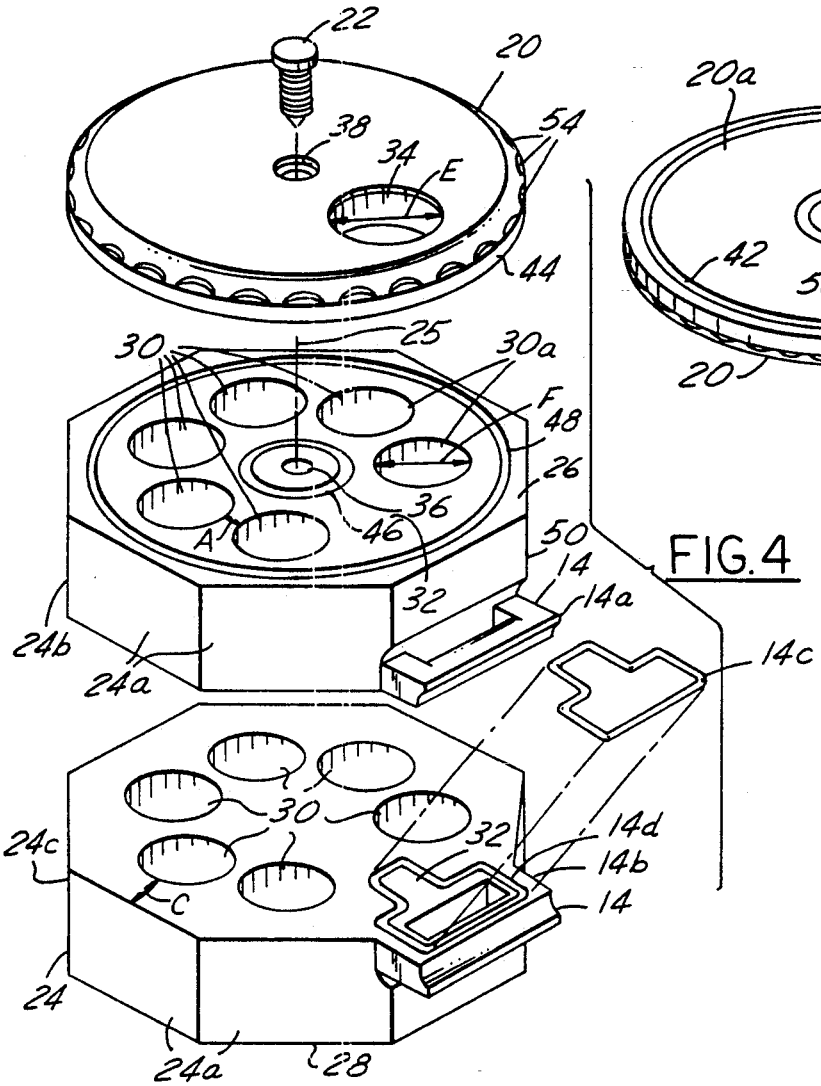
FIG. 4 is an exploded perspective view of the multiply compartmented cooler according to the present invention.

Referring now to the Drawing, FIG. 1 shows the multiply compartmented cooler 10 according to the present invention in a typical environment of use, wherein the multiply compartmented cooler is releasably connected to a golf club bag cart 12 via a handle 14 and a strap 16. The multiply compartmented cooler 10 is structured to provide a plurality of individual compartments for respectively insulatively storing contents therein, such as a beverage can (see FIG. 6). In this regard, the multiply compartmented cooler 10 is composed generally of a body 18 and a lid 20 rotatively connected to the body via a pivot pin 22.

The structure and function of the multiply compartmented cooler 10 will now be detailed with greater specificity with reference now additionally being had to FIGS. 2 through 6.

As depicted in FIG. 2, the body 18 preferably has a side wall 24 shaped in the form of a plurality of flat faces 24a (which may or may not be provided with a fanciful design), such as that formed by the octagon shape shown; although this is not a requirement, the side wall is preferred to have a plurality of flat faces since any flat face may provide a side upon which the body may rest on a surface, without any tendency of the body to roll on the surface. The body 18 is constructed from a lightweight, rigid, durable, insulative material, such as an expandable polystyrene 3# or 4# pcf. The body 18 has a top end 26 and a bottom end 28.

Figure 6:
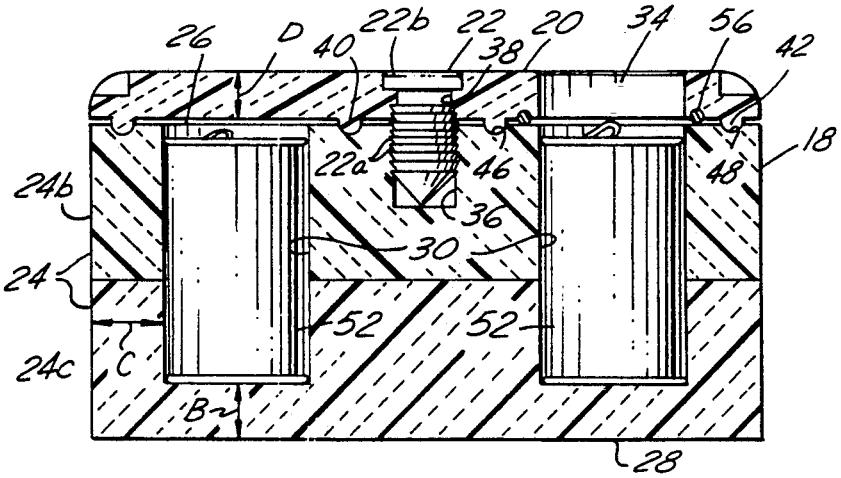
FIG. 6 is a partly sectional perspective side view of the multiply compartmented cooler according to the present invention, shown in operation and seen along line 6—6 in FIG. 2.

As can be seen from FIGS. 4 and 6, a plurality of compartments 30 are provided in the body 18, wherein each compartment is in the form of a blind cavity having its opening 30a at the top end 26 of the body. As can be seen from FIG. 4, each compartment 30 is separated from each adjacent compartment by at least a first predetermined distance A so that each compartment is substantially thermally isolated from each other compartment; further each compartment has a head 30b located at least a second predetermined distance B from the bottom end 28 of the body 18 so that the compartments are substantially thermally isolated from the bottom end; and still further each compartment is separated from the side wall 18 at least a third predetermined distance C so that the compartments are substantially thermally isolated from the side wall.

A dead-space 32 is provided between a selected two adjacent compartments 30 whereat no compartment is located in the body 18. The dead-space 32 has a cross-section at least equal to the cross-section F of the compartments 30.

As shown in FIGS. 2 and 4, the handle 14 is preferably integrally connected with the body 18. In order to provide a reinforced handle structure, it is preferred to construct the body 18 of upper and lower body segments 24b, 24c which bisect the body 18 through the handle 14. Accordingly a first handle portion 14a is integrally connected with the upper body segment 24b, while a second handle portion 24b is connected with the lower body portion 24c. A T-shaped reinforcing wire 14c is located between the two handle portions 24a, 24c and placed between the two body segments 24b, 24c at the dead-space 32 via a groove 14d so as to reinforce the handle and anchor it structurally to a location deep within the dead-space. The two body segments 24b, 24c are then connected together by adhesive or another interconnection process known in the art.

As shown in FIGS. 1 and 3, it is preferred to include a strap 16 which is wrapped around the handle 14 which serves to releasably connect the handle to another object, preferably in cooperation with a concave shaped end of the handle (see FIG. 3). Preferably, the strap 16 is provided with hook and loop fastener ends 16a, 16b, such as that provided by a product sold under the trademark VELCRO.

The lid 20 is shaped to adjacently cover the top end 26 of the body 18. The lid 20 is preferably constructed of a lightweight insulative material, such as the preferred material described hereinabove for the body 18. As can be seen in FIG. 6, the lid 20 has a thickness D which provides substantial thermal isolation of each of the compartments 30. As can be seen in FIG. 4, the lid 20 is provided with an access port 34 which is dimensioned to have a cross-section E on the order of that of the cross-section F of the compartments 30.

The lid 20 is connected with the body 18 via a pivot pin 22. In this regard, a preferred pivot pin 22 (as is shown in FIGS. 4 and 6) has a plurality of annular perimeter grooves 22a for gripping the sidewall of a blind axial bore 36 in the body 18. An example of such a pivot pin 22 is that distributed under the trademark "Christmas Tree" clips, the blunt point style thereof being preferred. Preferably the head 22b of the pivot pin 22 is seatably recessed in an axial hole 38 in the lid 20, as shown in FIG. 6.

Figure 5:
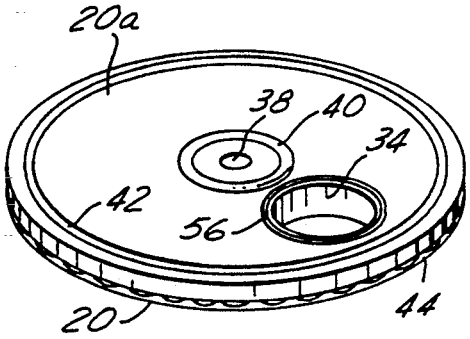
FIG. 5 is a perspective view of the underside of the lid of the multiply compartmented cooler according to the present invention.

As can be seen in FIG. 5, the underside 20a of the lid 20 is provided with a first annular gasket 40 located substantially adjacent the axial hole 38, and a second annular gasket 42 located substantially adjacent the perimeter 44 of the lid. Preferably, the second annular gasket 42 has a higher relief from the underside 20a than that of the first annular gasket 40; but the reliefs can also be the same, as is shown in FIG. 6. Preferably, the first and second annular gaskets are integrally connected with the lid. Of course, the location of the first and second annular gaskets and the first and second annular grooves may be reversed as between the lid and the top end of the body. As can be seen from FIG. 4, the top end 26 of the body 18 is provided with a first annular groove 46 for receiving the first annular gasket 40, and a second annular groove 48 for receiving the second annular gasket 42. Accordingly, the lid 20 may rotate on the pivot pin 22 and simultaneously the first annular gasket 40 will sealably track in the first annular groove 46 and the second annular gasket 42 will sealably track in the second annular groove 48, without the underside 20a of the lid directly sliding or scraping against the top end 26 of the body 18 as the lid is rotated relative to the body.

It is preferred for the lid 20 to be provided with a plurality of indentations 54 spaced around the perimeter 44 of the lid. The indentations 54 serve as finger placement locations which aid a user to rotate the lid 20 with respect to the body 18.

The compartments 30 and the dead-space 32 are arranged equidistant from the axial center 25 of the body 18, the axial center being defined by the location of the blind axial bore 36. The access port 34 in the lid 20 is also located the same distance from the axial hole 38 (located in alignment with the axial center 25 of the body) as are the compartments 30 distanced from the blind axial bore 36. Accordingly, as the lid 20 is rotated on the pivot pin 22, the access port 34 is alignable with any of the compartments 30 or, alternatively, the dead-space 32.

Preferably, an annular gasket 56 is provided adjacent the access port 32 at the underside 20a of the lid 20 (or at the top end of the body) for providing a seal between the access port and the top end 26 of the body 18. The annular gasket 56 is preferably constructed of a low friction plastic. The annular gasket 56 has a relief which provides close adjacency to the top end 26, thereby minimizing or eliminating friction as it rotates about the axial center 25 as the lid 20 is rotated.

Although six compartments 30 are shown, any number of compartments is possible depending upon the cross-section F of the compartments and the perimeter 50 of the body, as defined by the side wall 24.

In operation, a user rotates the lid 20 so as to bring the access port 34 into alignment with the opening 30a of a compartment 30 and thereupon places one or more articles into the compartment. The lid is then rotated so that the access port is aligned with the next compartment and article placement again ensues. This process is repeated until all the compartments are stocked. Thereupon, the access port is rotated over the dead-space 32 so that all the compartments are substantially thermally isolated. Any compartment may now be accessed by rotating the lid so that the access port is directly thereabove.

While beverage cans 52 are a preferred article for storage in the compartments, other articles can be stored therein, including non-food items, such as for instance (but not limitation) golf balls and tees when the multiple compartment cooler is used on a golf course.

It is to be noted further, that while cylindrically shaped compartments 30 are preferred, compartments of other shapes are acceptable, as well, provided the dead-space 32 and the access port 34 are similarly shaped to accommodate the alternative shape of the compartments.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A multiply compartmented cooler for selectively storing articles, comprising:

a body constructed of an insulative material, said body having a top end, a bottom end and a side wall connecting with said top end and said bottom end, said body having an axial center defined by said side wall, said body having a body perimeter defined by said side wall, said body being provided with a plurality of compartments, each compartment of said plurality of compartments being defined by a blind cavity having an opening at said top end of said body, said plurality of compartments being arranged in a predetermined pattern such that each said compartment is located at least substantially equidistant from said axial center, said predetermined pattern further providing a dead-space between a selected two adjacent said compartments, said dead-space having a predetermined cross-section;

a lid constructed of an insulative material, said lid having an underside, said lid being rotatively connected to said top end of said body at said axial center thereof, said lid being provided with an access port, said access port having a cross-section no greater than said predetermined cross-section; said lid substantially covering said top end of said body; and means for rotatively connecting said lid to said body;

wherein said access port is located on said lid such that as said lid is rotated, said access port comes into sequential alignment with said opening of each said compartment and with said dead-space, wherein further said access port when aligned with said opening of a compartment of said plurality of compartments thereby provides an opening into that compartment for inserting and removing at least one article with respect thereto.

2. The multiply compartmented cooler of claim 1, wherein said insulative material of said body and said lid comprises an expanded polymer material.

3. The multiply compartmented cooler of claim 1, further comprising annular gasket means for providing a seal between said underside of said lid and said top end of said body and further for providing a sliding contact interface between said underside of said lid and said top end of said body.

4. The multiply compartmented cooler of claim 3, wherein said annular gasket means comprises:

a first annular gasket located substantially adjacent said axial center of said body and connected to one of said underside of said lid and said top end of said body;

a first annular groove located substantially adjacent said axial center of said body and connected to the other of said underside of said lid and said top end of said body;

a second annular gasket located substantially adjacent said body perimeter and connected to one of said underside of said lid and said top end of said body; and a second annular groove located substantially adjacent said body perimeter and connected to the other of said underside of said lid and said top end of said body.

5. The multiply compartmented cooler of claim 4, further comprising access port gasket means for sealing said underside of said lid with respect to said top end of said body at a location adjacent said access port.

6. The multiply compartmented cooler of claim 5, wherein said side wall of said body is provided with a plurality of flat faces.

7. The multiply compartmented cooler of claim 6, wherein each said compartment is separated from each other said compartment by at least a first predetermined distance so that each said compartment adjacent thereto is substantially thermally isolated from each other said compartment; further wherein each said compartment has a head located at least a second predetermined distance from said bottom end of said body so that each said compartment is substantially thermally isolated from said bottom end; and further wherein each said compartment is separated from said side wall at least a third predetermined distance so that each said compartment is substantially thermally isolated from said side wall.

8. The multiply compartmented cooler of claim 7, wherein said body is provided with a handle.

9. The multiply compartmented cooler of claim 8, wherein said lid has a lid perimeter, further wherein said lid is provided with a plurality of indentations located adjacent said lid perimeter for providing finger placement locations that serve as an aid to effecting rotation of said lid with respect to said body.

10. The multiply compartmented cooler of claim 9, wherein said access port, each said compartment and said dead-space all have substantially said predetermined cross-section.

11. The multiply compartmented cooler of claim 10, wherein said insulative material of said body and said lid comprises an expanded polymer material.

12. The multiply compartmented cooler of claim 11, wherein said handle is integrally connected with said side wall of said body.

13. The multiply compartment cooler of claim 12, wherein said handle has an end of predetermined shape; further comprising strap means for selectively connecting said handle to an object in combination with said predetermined shape of said end of said handle.

14. The multiply compartmented cooler of claim 3, wherein said side wall of said body is provided with a plurality of flat faces.

15. The multiply compartmented cooler of claim 3, wherein said body is provided with a handle.

16. The multiply compartmented cooler of claim 15, wherein said handle is integrally connected with said side wall of said body.

17. The multiply compartmented cooler of claim 16, wherein said handle has an end of predetermined shape; further comprising strap means for selectively connecting said handle to an object in combination with said predetermined shape of said end of said handle.

18. The multiply compartmented cooler of claim 3, wherein said lid has a lid perimeter, further wherein said lid is provided with a plurality of indentations located adjacent said lid perimeter for providing finger placement locations that serve as an aid to effecting rotation of said lid with respect to said body.

19. The multiply compartment cooler of claim 3, wherein said access port, each said compartment and said dead-space all have substantially said predetermined cross-section.

20. The multiply compartmented cooler of claim 3, wherein each said compartment is separated from each other said compartment by at least a first predetermined distance so that each said compartment adjacent thereto is substantially thermally isolated from each other said compartment; further wherein each said compartment has a head located at least a second predetermined distance from said bottom end of said body so that each said compartment is substantially thermally isolated from said bottom end; and further wherein each said compartment is separated from said side wall at least a third predetermined distance so that each said compartment is substantially thermally isolated from said side wall.

* * * * *